United States Patent [19]

Brisco

[11] Patent Number: 4,569,396

[45] Date of Patent: Feb. 11, 1986

[54] SELECTIVE INJECTION PACKER

[75] Inventor: David P. Brisco, Duncan, Okla.

[73] Assignee: Halliburton Company, Duncan, Okla.

[21] Appl. No.: 659,994

[22] Filed: Oct. 12, 1984

[51] Int. Cl.[4] ..... E21B 43/16; E21B 23/06

[52] U.S. Cl. ..... 166/305.1; 166/185; 166/191; 166/387

[58] Field of Search ..... E21B/33/124; 166/183–187, 191, 387, 127, 128, 131, 133, 305 R, 306, 311, 312

[56] References Cited

U.S. PATENT DOCUMENTS

| | | | |
|---|---|---|---|
| 2,227,730 | 1/1941 | Lynes | 166/187 |
| 2,227,731 | 1/1941 | Lynes | 166/187 |
| 2,715,444 | 8/1955 | Fewel | 166/187 |
| 2,824,612 | 2/1958 | Lynes | 166/191 |
| 2,831,541 | 4/1958 | Conover | 166/120 |
| 3,122,205 | 1/1964 | Brown et al. | 166/120 |
| 3,136,364 | 6/1964 | Myers | 166/120 |
| 3,865,188 | 2/1975 | Doggett et al. | 166/186 |
| 3,876,000 | 4/1975 | Nutter | 166/187 |
| 4,279,306 | 7/1981 | Weitz | 166/187 |
| 4,424,860 | 1/1984 | McGill | 166/187 |
| 4,460,041 | 7/1984 | Berryman | 166/128 |
| 4,484,625 | 11/1984 | Barbee, Jr. | 166/185 |
| 4,485876 | 12/1984 | Speller | 166/373 |
| 4,519,456 | 5/1985 | Cochran | 166/187 |

FOREIGN PATENT DOCUMENTS

| | | | |
|---|---|---|---|
| 235230 | 8/1964 | Austria | 166/187 |

*Primary Examiner*—Stephen J. Novosad
*Assistant Examiner*—Bruce M. Kisliuk
*Attorney, Agent, or Firm*—Lucian W. Beavers; Joseph A. Walkowski; Thomas R. Weaver

[57] ABSTRACT

A selective injection packer apparatus includes a housing having a longitudinal housing bore therethrough. A mandrel has a longitudinal mandrel bore therethrough and is slidably disposed in the housing bore. Upper and lower longitudinally spaced compressible packers are disposed about the housing. Upper and lower power pistons are operably associated with the housing and the upper and lower packers, respectively, for longitudinally compressing and radially expanding the upper and lower packers in response to an increase in fluid pressure within the mandrel bore. A power passage is operatively associated with the power pistons for selectively communicating the mandrel bore with the power pistons. An injection passage is operatively associated with the housing and the mandrel for selectively communicating the mandrel bore with an exterior of the housing between the upper and lower packers. A release passage is operatively associated with the housing and the mandrel for selectively communicating an upper exterior of the housing above the upper packer and a lower exterior of the housing below the lower packer with both the power passage and the injection passage concurrently to thereby balance fluid pressures on the upper and lower power pistons and the upper and lower packers to allow the upper and lower packers to release from sealed engagement with the well bore.

20 Claims, 6 Drawing Figures

SELECTIVE INJECTION PACKER

BACKGROUND OF THE INVENTION

1. Field of the Invention

The present invention relates to apparatus for use in oil and gas wells or the like, and particularly to selective injection packers of the type having a pair of longitudinally spaced packers and having an injection port located between the packers.

2. Description of the Prior Art

It is often necessary to selectively treat relatively short perforated intervals in oil and gas wells while isolating the treatment area from other intervals in the well bore. For example, this may be done for the purpose of washing the perforations or for injecting treatment chemicals into the formation.

Furthermore, it may be desirable to isolate such short intervals for the purposes of testing flow and/or pressure at various levels of a particular producing formation in order to ascertain whether there is damage to some or all perforations or the formation, whether it is desirable to treat the entire formation in some manner, or whether only certain intervals need be subjected to treatment.

There are a number of ways to accomplish these operations. For example, a bridge plug and a packer may be set below and above the interval, respectively, and the interval then treated through the packer. This has the disadvantage of requiring setting and unsetting of two tools for each treatment or test interval.

Alternatively, a straddle-type packer having two sealing elements may be employed. Such straddle-type devices may have sealing elements which are compressible, inflatable or expandable (cup-type).

Inflatable elements require relatively complex valving, particularly if it is desired to set and unset the tool a number of times. In addition, such tools are long and bulky, and in many cases require fairly precise control of tubing pressures for inflation, as well as separate inflation channels or lines.

Cup-type elements are severely restricted in the amount of pressure they can contain, are susceptible to severe frictional wear in deep holes, and require a bypass around the cups if it is desired to reverse-circulate in the well bore.

Compressible packer elements possess advantages over other types of packer elements, but most tools employing compressible packer elements are weight-set, thereby restricting their use to deeper wells and often preventing their exact location at a particular interval.

The present invention relates to a straddle-type packer of the type having compressible packer elements which are hydraulically set. An example of a prior art device having hydraulically set compressible packer elements is shown in U.S. Pat. No. 2,715,444 to Fewel. In the Fewel device, a pair of pistons are operated by tubing pressure to longitudinally compress and radially extend a pair of spaced compressible type packers to seal the packers against the well bore. Then, tubing string weight is slacked off to set down a mandrel portion of the device and move it longitudinally relative to a housing which is attached to the packer elements, to open an injection port located between the packer elements.

The present invention provides a number of improvements in devices of the type generally shown in the Fewel patent.

SUMMARY OF THE INVENTION

The selective injection packer apparatus of the present invention has a housing means having a longitudinal housing bore therethrough. A mandrel means has a longitudinal mandrel bore therethrough and is slidably disposed in the housing bore of the housing means.

Upper and lower longitudinally spaced compressible packer means are disposed about the housing means. A power piston means is operably associated with the housing means and the upper and lower packer means for longitudinally compressing and radially expanding the upper and lower packer means in response to a change in fluid pressure within the mandrel bore.

A power passage means is operatively associated with the power piston means for selectively communicating the mandrel bore and the power piston means in order that the power piston means may be operated to compress the upper and lower packer means.

An injection passage means is operatively associated with the housing means and the mandrel means for selectively communicating the mandrel bore with an intermediate exterior surface of the housing means between the upper and lower packer means so that fluids may be injected into a zone defined between the upper and lower packer means, or alternatively so that zone may be tested.

A release passage means is operatively associated with the housing means and the mandrel means for selectively communicating an upper exterior surface of the housing means above the upper packer means and a lower exterior surface of the housing means below the lower packer means with both the power passage means and the injection passage means concurrently to thereby balance fluid pressures on the power piston means and the upper and lower packer means. This release passage means permits the upper and lower packer means to be released in any number of situations wherein conditions within the well would prevent the packers from releasing merely upon communicating the power passage means with the mandrel bore and decreasing pressure within the mandrel bore.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
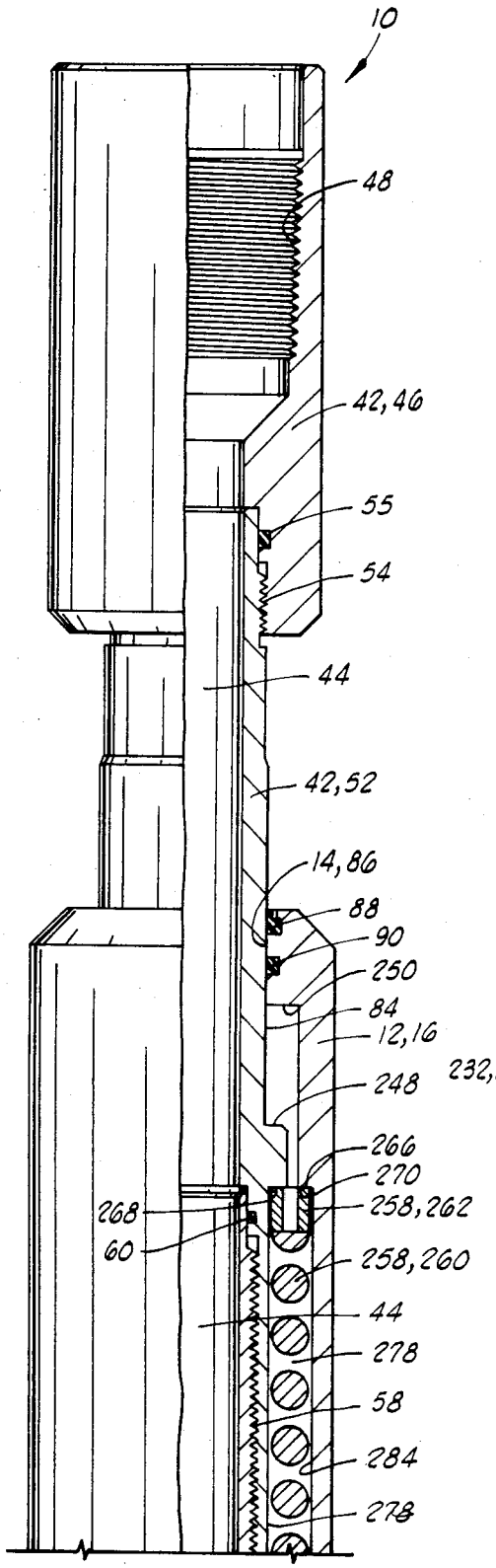
FIGS. 1A–1D comprise an elevation right side only section view of the selective injection packer apparatus of the present invention.

Referring now to the drawings, and particularly to FIGS. 1A–1D, the selective injection packer apparatus of the present invention is shown and generally designated by the numeral 10.

The selective injection packer apparatus 10 includes a housing means 12 having a longitudinal housing bore 14 disposed therethrough.

The housing means 12 is constructed from a number of threadedly connected tubular members which, beginning at the upper end of housing means 12, include a spring chamber housing 16.

Housing means 12 further includes an upper relief housing 18 having an upper end threadedly connected to a lower end of spring chamber housing 16 at threaded connection 20.

An upper packer housing adapter 22 of housing means 12 has an upper end which is threadedly connected to a lower end of upper relief housing 18 at threaded connection 24.

An upper packer housing 26 of housing means 12 has an upper portion threadedly connected to a lower end of upper packer housing adapter 22 at threaded connection 28.

An injection port adapter 30 of housing means 12 has its upper end threadedly connected to a lower end of upper packer housing 26 at threaded connection 32.

A lower packer housing 34 of housing means 12 has its upper end threadedly connected to a lower end of injection port adapter 30 at threaded connection 36.

A lower packer housing adapter 38 of housing means 12 is concentrically disposed about lower packer housing 34 and threadedly connected thereto at threaded connection 40.

A mandrel means generally designated by the numeral 42 has a longitudinal mandrel bore generally designated by the numeral 44 disposed therethrough. The mandrel means 42 is slidably disposed in the housing bore 14 of housing means 12.

The mandrel means 42 is also constructed from a plurality of tubular members which are threadedly connected together, and beginning at its upper end, mandrel means 42 includes an upper adapter 46. Upper adapter 46 has a set of internal threads 48 adapted to be connected to a tubing string such as tubing string 50 seen in FIG. 3.

An upper spring mandrel 52 of mandrel means 42 has its upper end threadedly connected to a lower end of upper adapter 46 at threaded connection 54, with a seal being provided therebetween by resilient O-ring seal means 55.

A lower spring mandrel 56 of mandrel means 42 has its upper end threadedly connected to a lower end of upper spring mandrel 52 at threaded connection 58, wth a resilient seal being provided therebetween by resilient O-ring seal means 60.

An upper power mandrel 62 of mandrel means 42 has its upper end threadedly connected to a lower end of lower spring mandrel 56 at threaded connection 64 with a seal being provided therebetween by resilient O-ring seal means 66.

A lower power mandrel 68 of mandrel means 42 has its upper end threadedly connected to a lower end of upper power mandrel 62 at threaded connection 70 with a seal being provided therebetween by resilient O-ring seal means 72.

A lower adapter 74 of mandrel means 42 has its upper end threadedly connected to a lower end of lower power mandrel 68 at threaded connection 76 with a seal being provided therebetween by resilient O-ring seal 78. Lower adapter 74 has an external thread 80 on its lower end for connection to a lower seat housing such as 82 seen in FIG. 3.

An external cylinder surface 84 of upper spring mandrel 52 is closely received within an upper bore 86 of spring chamber housing 16 with a sliding seal being provided therebetween by resilient O-ring 90 which is disposed in a corresponding groove within the bore 86. Wiper ring 88 in an adjacent groove protects O-ring 90 by preventing sand, etc., from contacting and abrading the latter. The upper bore 86 of spring housing 16 is a portion of the housing bore 14 of housing means 12.

An external surface 92 of upper power mandrel 62 is closely received within a bore 94 of upper packer housing 26. Bore 94 is also a portion of housing bore 14.

A number of sliding seals are provided between surfaces 92 and 94, including an upper seal provided by resilient O-ring 96 disposed in a corresponding groove within bore 94 of upper packer housing 26, a first intermediate seal provided by resilient O-ring 98 disposed in a corresponding groove of outer surface 92 of upper power mandrel 62, a second intermediate seal provided by resilient O-ring seal means 100 disposed in a corresponding groove of external surface 92 of upper power mandrel 62, and a lowermost seal provided by double resilient O-ring seal means 102 disposed in an annular groove in the lower end of inner surface 94 of upper packer housing 26.

Lower power housing mandrel 68 includes an external cylindrical surface 104 which is in effect an extension of external surface 92 of upper power mandrel 62. With the mandrel means 42 in the position illustrated in FIG. 1C, a very lowermost portion of external surface 92 of upper power mandrel 62 is closely received within an inner cylindrical surface 106 of lower packer housing 34 with a seal being provided therebetween by double resilient O-ring seal means 108 disposed in an upper annular groove of inner surface 106 of lower packer housing 34. It will be understood that as the mandrel means 42 reciprocates relative to the housing means 12, the external surfaces 92 and 104 of upper and lower power mandrels 62 and 68 will each at certain times be in sealing engagement with the seals such as 102 and 108. Surface 106 is also a portion of housing bore 14.

A number of additional sliding seals are provided between external surface 104 of lower power mandrel 68 and internal cylindrical surface 106 of lower packer housing 34, including first, second and third O-ring seals 110, 112 and 114 disposed in corresponding grooves in external surface 104 of lower power mandrel 68, and including fourth and fifth O-ring seals 116 and 118 disposed in corresponding grooves in internal surface 106 of lower packer housing 34. Wiper ring 120 is also disposed in a groove in surface 106 below O-ring seal 118.

Upper and lower longitudinally spaced compressible packer means 122 and 124 are disposed about housing means 12.

Power piston means 126, including an upper power piston 128 and a lower power piston 130, is operably associated with the housing means 12 and the upper and lower packer means 122 and 124 for longitudinally compressing and radially expanding the upper and lower packer means 122 and 124 in response to an increase in fluid pressure within mandrel bore 44.

Upper power piston 128 has an upper inner bore 132 slidably received about an outer surface 134 of upper packer housing 26 of housing means 12 with a first sliding seal being provided therebetween by resilient O-ring seal means 136.

Upper power piston 128 further includes a lower enlarged inner diameter counterbore 138 slidably received about an outer cylindrical surface 140 of injection port adapter 30 with a debris barrier being provided therebetween by resilient wiper ring 142.

The outer surface 140 of injection port adapter 30 of housing means 12 may be generally referred to as an enlarged diameter cylindrical outer surface of housing means 12, as compared to the outer cylindrical surface 134 of upper packer housing 26 of housing means 12.

A differential area piston is defined on upper power piston 128 between annular seals 136 and 320.

A power passage means 144 includes an upper power passage 146 and a lower power passage 148, and is operatively associated with the upper and lower power pistons 128 and 130 for selectively communicating mandrel bore 44 of mandrel means 42 with the upper and lower power pistons 128 and 130.

Upper power passage 146 includes an upper mandrel power port 150 disposed through a wall of upper power mandrel 62 and communicating mandrel bore 44 with an elongated external groove 152 disposed in outer surface 92 of upper power mandrel 62. Groove 152 also forms a portion of upper power passage 146.

Upper power passage 146 further includes an upper housing power port 154 disposed through a wall of upper packer housing 26 and communicating groove 152 with an elongated annular groove 156 of upper power passage 146 which is disposed in outer surface 134 of upper packer housing 26.

Elongated annular groove 156 of upper power passage 146 communicates with an upper power chamber 158 of upper power passage 146. Upper power chamber 158 is an annular chamber defined between upper packer housing 26 and an irregular inner surface of upper power piston 128, which irregular inner surface includes the counterbore 138 of upper power piston 128 extending to annular seal 320.

Upper power chamber 158 is communicated with the differential area piston defined on upper power piston 128 between seals 136 and 142 so that pressures from mandrel bore 44 communicated to said differential area piston through upper power passage 146 acts upwardly on upper power piston 128.

Figure 1B:
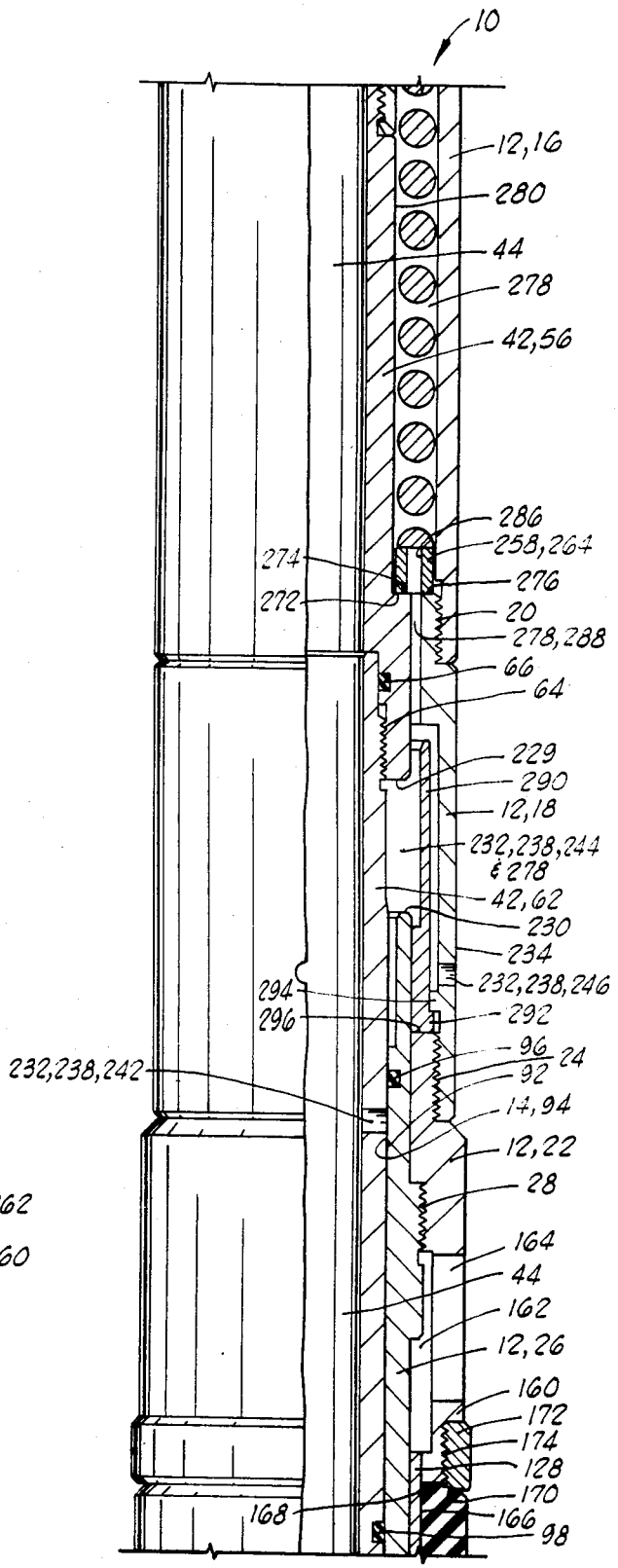

As seen in FIG. 1B, upper power piston 128 has its upper end concentrically received between upper packer housing 26 and a downwardly extending annular skirt 160 of upper packer housing adapter 22.

An annular low pressure cavity 162 is defined between upper packer housing 26 and skirt 160, and is communicated with the exterior surface of upper packer housing adapter 22 and thus with the well bore through an elongated radially extending slot 164.

Thus, fluid pressures within the well bore are communicated with the upper end of upper power piston 128 through slot 164. When the pressure within mandrel bore 44 which acts on the differential area piston defined between seals 136 and 320 exceeds the pressure within the well bore, that upward pressure differential will act on upper power piston 128 to cause it to move upward.

The upper packer means 122 is closely received about an outer cylindrical surface 166 of an upper portion of upper power piston 128. The upper end of upper packer means 122 abuts a lower end 168 of skirt 160 and a lower end 170 of a packer retaining ring 172. The packer retaining ring 172 is threadedly connected to skirt 170 of upper packer housing adapter 22 at threaded connection 174.

Similarly, a lower end of upper packer means 122 abuts an upward facing external shoulder 176 of upper power piston 128 and an upward end 178 of a packer retaining ring 180. Packer retaining ring 180 is threadedly connected to upper power piston 128 at threaded connection 182.

Figure 3:
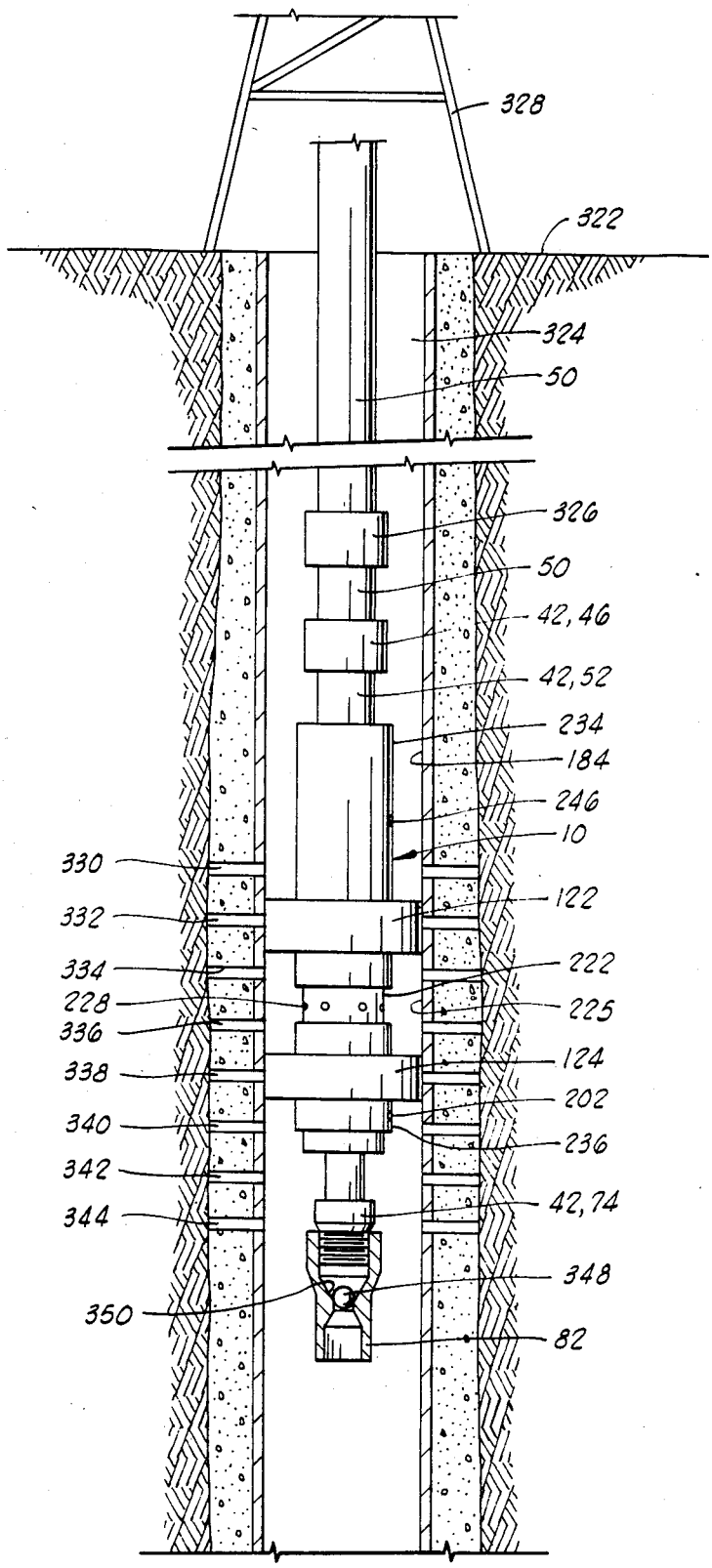
FIG. 3 is a schematic elevation view illustrating the manner in which the selective injection packer apparatus is utilized within a well.

As the upper power piston 128 moves upward relative to upper packer housing 26 and upper packer housing adapter 22 of housing means 12, upper packer means 122 is longitudinally compressed between upper surfaces 168, 170 and lower surfaces 176, 178, and is thereby radially expanded such as schematically illustrated in FIG. 3 to seal against a well bore 184.

Lower power piston 130 and lower packer means 124, and the various structures associated therewith are constructed in a manner similar to that just described in detail for upper power piston 128 and upper packer means 122.

The lower power passage 148 includes a lower mandrel power port 186, an elongated external annular groove 188 in lower power mandrel 168, a lower housing power port 190 disposed through lower packer housing 34, an elongated external annular groove 192 disposed in lower packer housing 34, and a lower power chamber 194.

A lower end 196 of lower power piston 130 is concentrically received between lower packer housing 34 and an upward extending skirt 198 of lower packer housing adapter 38.

A lower low pressure cavity 200 is defined between lower packer housing 34 and lower packing housing adapter 38, with an elongated radially extending slot 202 extending through lower packer housing adapter 38 to communicate cavity 200 with the well bore below lower packer means 124.

A differential area piston is defined on lower power piston 130 between an upper annular seal 321 and a lower O-ring seal 206. Wiper ring 204 provides a debris barrier above seal 321.

The upper end of lower packer means 124 abuts a downward facing outwardly extending shoulder 208 of lower power piston 130 and a lower end 210 of a packer retaining ring 212.

A lower end of lower packer means 124 abuts an upper end 214 of skirt 198 of lower packer housing adapter 38, and an upper end 216 of a packer retaining ring 218.

Selective injection packer apparatus 10 further includes an injection passage means 220 operatively associated with housing means 12 and mandrel means 42 for selectively communicating mandrel bore 44 with an intermediate exterior surface 222 of injection port adapter 30 of housing means 12 between upper and lower packer means 122 and 124. This, of course, communicates injection passage means 220 with a portion 225 of well bore 184 (see FIG. 3) defined between upper and lower packers 122 and 124.

Injection passage means 220 includes a plurality of radially extending mandrel injection ports 224 disposed through upper power mandrel 62, an annular radially inner groove 226 of injection port adapter 30, and a plurality of radially extending housing injection ports 228 extending radially through injection port adapter 30.

When selective injection packer apparatus 10 is in the position illustrated in FIGS. 1A–1D, which may be referred to as a neutral first position, the injection passage means 220 is closed in that seals 102 and 108 prevent communication of mandrel bore 44 with the groove 226 and the housing injection ports 228. When mandrel means 42 is moved longitudinally downward relative to housing means 12, as will be further explained below, the mandrel injection ports 224 move to a position between seals 102 and 108 and are in registry with groove 226 to provide fluid communication between mandrel bore 44 and housing injection ports 228 so that fluid may be injected into the portion 225 of well bore 184 between upper and lower packer means 122 and 124, and similarly so that the subsurface zone adjacent portion 225 of well bore 184 may be tested or the like.

When the mandrel means 42 is moved downward relative to housing means 12, that downward movement is limited by engagement of a radially outward extending mandrel limit abutment 229 (see FIG. 1B) which is a lower end of lower spring mandrel 56, with a radially inward extending housing limit abutment 230 which is an upper end of upper packer housing 26. The abutting engagement of abutments 229 and 230 defines a lower second position of mandrel means 42 relative to housing means 12, and it is in this lower second position that the mandrel injection ports 224 are aligned with groove 226 and housing injection ports 228.

Selective injection packer apparatus 10 also includes a release passage means 232 operatively associated with housing means 12 and mandrel means 42 for selectively communicating an upper exterior surface 234 of housing means 12 above upper packer means 122 and a lower exterior surface 236 of housing means 12 below lower packer means 124 with both the power passage means 144 and the injection passage means 220 concurrently to thereby balance fluid pressures on upper and lower power pistons 128 and 130 and upper and lower packer means 122 and 124. Release passage means 232 includes an upper release passage 238 for communicating mandrel bore 44 with upper exterior 234 of housing means 12, and a lower release passage 240 for communicating mandrel bore 44 with lower exterior 236 of housing means 12.

Upper release passage 238 includes an upper mandrel release port 242 disposed radially through a wall of upper power mandrel 62, an annular cavity 244 defined between mandrel means 42 and upper relief housing 18 of housing means 12, and upper housing relief port 246 disposed through upper relief housing 18 and communicating cavity 244 with upper exterior surface 234 of housing means 12.

When selective injection packer apparatus 10 is in its neutral first position as illustrated in FIGS. 1A–1D, the upper release passage 238 is closed, because resilient O-ring seal 96 isolates upper mandrel release port 242 from annular cavity 244.

When mandrel means 42 is moved longitudinally upward relative to housing means 12 to an upper third position defined by engagement of an upward facing mandrel limit abutment 248 of upper spring mandrel 52 with a downward facing housing limit abutment 250 of spring chamber housing 16, the upper mandrel release port 242 of upper release passage 238 is moved upward past resilient O-ring seal 96 so as to communicate with annular cavity 244 thus providing communication of mandrel bore 44 with upper exterior surface 234 of housing means 12 when mandrel means 44 is in its upper third position relative to housing means 12.

Similarly, lower release passage 240 includes a plurality of lower mandrel release ports 252 disposed radially through lower power mandrel 68, an annular radially inner groove 254 of lower packer housing 34, a plurality of lower housing release ports 256 disposed radially through lower packer housing 34, the annular cavity 200 previously described, and the radially extending slots 202 previously described which extend through lower packer housing adapter 38.

When mandrel means 42 is in its neutral first position relative to housing means 12 as illustrated in FIGS. 1A–1D, the lower release passage 240 is also closed since resilient O-ring seal 116 isolates lower mandrel release ports 252 from the remainder of lower release passage 240.

When mandrel means 42 moves upward relative to housing means 12 to its upper third position defined by engagement of abutments 248 and 250, the lower mandrel release ports 252 are moved upward above O-ring seal 116 and are communicated with groove 254 of lower release passage 240 thus providing communication between mandrel bore 44 and lower exterior surface 236 of housing means 12 below lower packer means 124.

Selective injection packer apparatus 10 further includes a resilient biasing means 258 which is operably associated with mandrel means 42 and housing means 12 for urging mandrel means 42 and housing means 12 toward the neutral first position of mandrel means 42 as illustrated in FIGS. 1A–1D from either of its previously described lower second and upper third positions.

The resilient biasing means 258 is a coil compression spring means 260 including upper and lower spring end rings 262 and 264.

The upper and lower spring end rings 262 and 264 may be considered to be the upper and lower ends of the coil compression spring 260.

The coil compression spring 260 is concentrically located between mandrel means 42 and spring chamber housing 16 of housing means 12.

An upper end 266 of upper spring end ring 262 is adapted to engage both an upper mandrel spring abutment 268 defined on upper spring mandrel 52 and an upper housing spring abutment 270 defined on spring chamber housing 16.

A lower end 272 of lower spring end ring 264 is adapted to engage both a lower mandrel spring abutment 274 defined on lower spring mandrel 56 and a lower housing spring abutment 276 defined on an upper end of upper relief housing 18.

When the mandrel means 42 is in its neutral first position relative to housing means 12 as illustrated in FIGS. 1A–1D, the coil compression spring means 260 is in its extendedmost position with its upper end 266 engaging both upper mandrel spring abutment 268 and upper housing spring abutment 270, and with its lower end 272 engaging both lower mandrel spring abutment 274 and lower housing spring abutment 276.

When mandrel means 42 is moved longitudinally downward relative to housing means 12 to its lower second position defined by engagement of abutments 229 and 230, the coil compression spring means 260 is compressed between upper mandrel spring abutment 268 and lower housing spring abutment 276, so that coil compression spring 260 continuously acts upon mandrel means 42 and housing means 12 to move them back toward the neutral first position of mandrel means 42.

When mandrel means 42 is moved longitudinally upward relative to housing means 12 to its upper third position defined by engagement of abutments 248 and 250, coil compression spring 260 is compressed between upper housing spring abutment 270 and lower mandrel spring abutment 274, so that coil compression spring 260 continuously urges mandrel means 42 back downward toward its neutral first position.

As seen in FIGS. 1A-1B, coil compression spring means 260 is received in an annular spring chamber 278 partially defined between external surfaces 278 and 280 of upper mandrel 52 and lower spring mandrel 56 on the one hand, and an inner cylindrical surface 284 of spring chamber housing 16 on the other hand. The annular spring chamber 278 is communicated with upper exterior surface 234 of housing means 12 by a plurality of longitudinal bores 286 disposed through lower spring end ring 264, and by an annular cavity 288 which communicates spring chamber 278 with the annular cavity 244 previously described which itself is communicated with upper housing release port 246 which is communicated with upper exterior surface 234 of housing means 12.

Annular cavities 288 and 244 may be considered to be a part of spring chamber 278.

The diameter of upper seal 90 and the seal 96 which sealingly define the upper and lowermost ends of spring chamber 278 are equal so that spring chamber 278 has a constant volume as mandrel means 42 is moved between its first, second and third positions relative to housing means 12, to thereby prevent well fluid from being sucked into spring chamber 278 or its associated cavity 244 as the mandrel means 42 is moved longitudinally relative to housing means 12.

An annular debris shield 290, which may also be referred to as a sand shield 290, is located within the annular cavity 244 and concentrically disposed about abutments 229 and 230 which, as previously described, define the lower second position of mandrel means 42 relative to housing means 12, for preventing debris such as sand which may enter upper housing release port 246 from collecting between abutments 229 and 230 and interfering with movement of mandrel means 42 longitudinally downward to its lower second position relative to housing means 12.

The sand shield 290 is an annular member including a radially outward extending flange 292 at its lower end which is held between an annular radially inward extending flange 294 of upper relief housing 18 and an upper end 296 of upper packer housing adapter 222.

Selective injection packer apparatus 10 further includes a pressure balance means 298 operatively associated with power passage means 144 and injection passage means 220 for transferring to power passage means 144 and thus to upper and lower power pistons 128 and 130 of power piston means 126 any pressure in injection passage means 220 in excess of a pressure trapped in power passage means 144 when the power passage means 144 is closed and the injection passage means 220 is open. this pressure balance means 298 prevents the upper and lower packer means 122 and 124 from being unseated from well bore 184 due to excessive pressure in injection passage means 220 and in the portion 225 of well bore 184 between the upper and lower packer means 122 and 124.

Pressure balance means 298 includes upper and lower sealed floating pistons 300 and 302, received in upper and lower power chambers 158 and 194, respectively.

Upper floating piston 300 includes an upper first end 304 which is in communication with upper power chamber 158 of upper power passage 146 of power passage means 144. Upper floating piston 300 further includes a lower second end 306. A pressure balance passage means 308 of pressure balance means 298 is disposed in injection port adapter 30 and communicates annular groove 226 of injection passage means 220 with the lower end 306 of upper floating piston 300 and with an upper end of lower floating piston 302.

Pressure balance passage means 308 includes one or more radially extending ports such as 310 which have their radially outer ends plugged with threaded plugs such as 312.

Each of the radial ports 310 of pressure balance passage means 308 is intersected by a longitudinally extending bore such as 314 of pressure balance passage means 308, which bore 314 is communicated with lower end 306 of upper floating piston 300 and the upper end of lower floating piston 302.

Figure 1C:
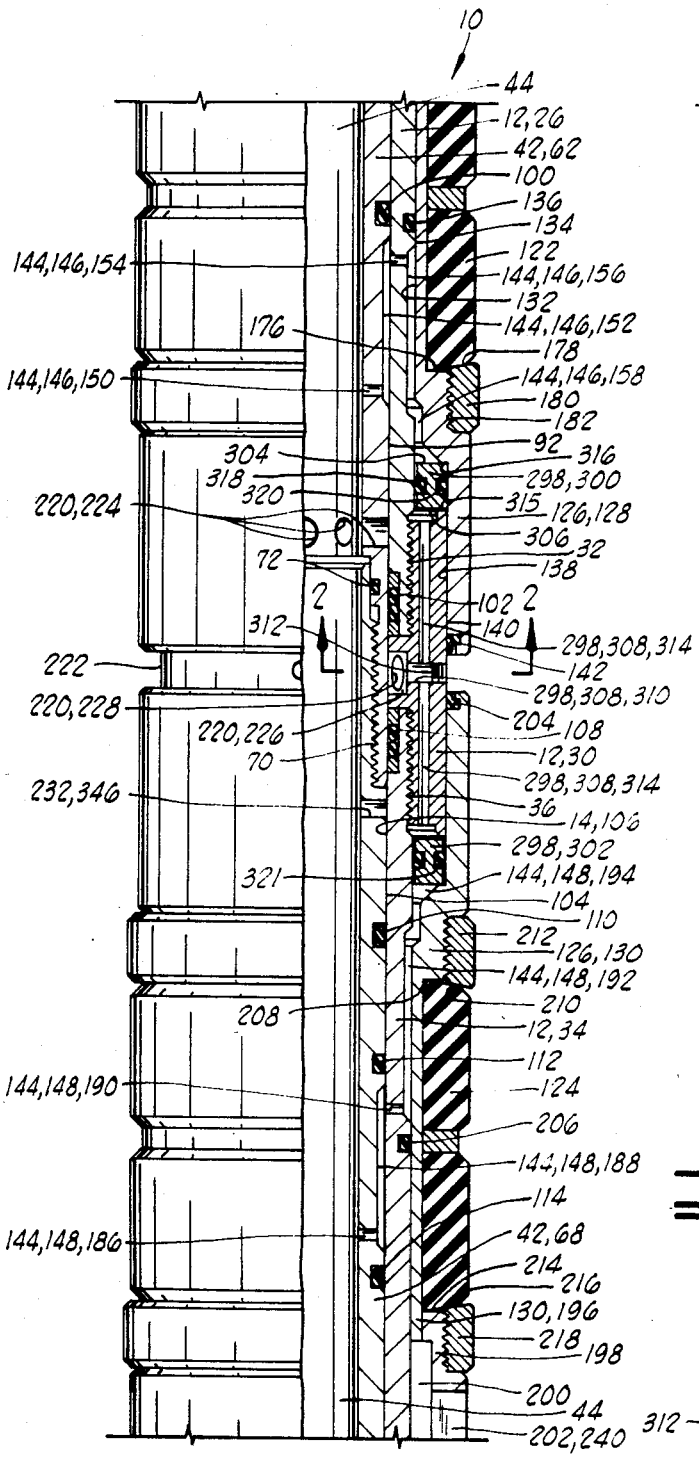
Figure 1D:
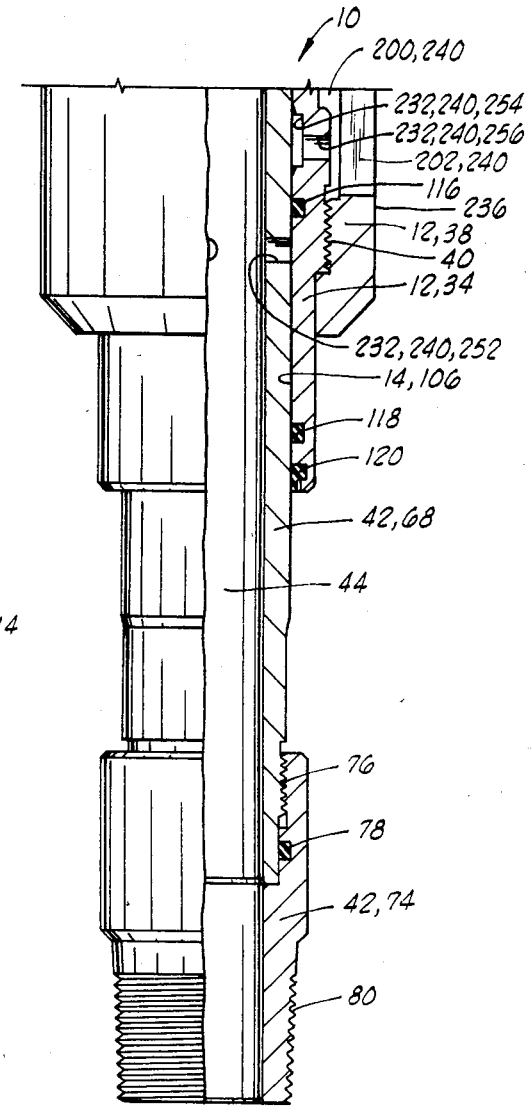
Figure 2:
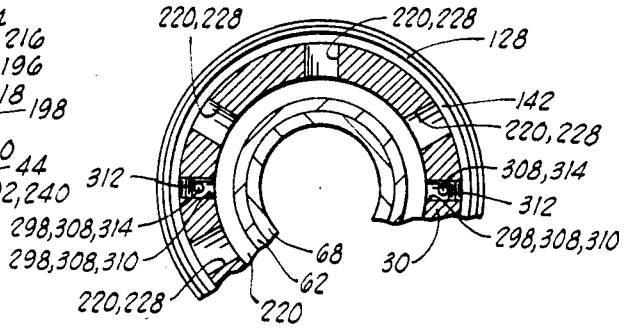
FIG. 2 is a partial sectional view taken along line 2—2 of FIG. 1C illustrating the arrangement of the injection ports in the housing means.

FIG. 2 is a sectional view along line 2—2 of FIG. 1C through the ports 310 of pressure balance passage means 308 and through housing injection ports 228 of injection passage means 220.

The upper floating piston 300 is held longitudinally in place between a lower piston abutment 315 of injection port adapter 30 of housing means 12 and an upper piston abutment 316 of upper power piston 128 when the upper power piston 128 is in an unactuated position as illustrated in FIGS. 1B-1C prior to compression of upper packer means 122.

Upper floating piston 300 has an annular inner seal 318 which provides a sliding seal between upper floating piston 300 and upper packer housing 26. Floating piston 300 includes an annular resilient outer seal 320 which provides a sliding seal between floating piston 300 and inner cylindrical counterbore 138 of upper power piston 128.

When fluid pressure is increased within mandrel bore 44 and accordingly in upper power passage 146, the upper power piston 128 moves longitudinally upward relative to housing means 12 as previously described, so that upper piston abutment 316 of upper power piston 128 is moved upward out of engagement with upper floating piston 300 so that upper floating piston 300 is then free to move upward within upper power chamber 158 if the fluid pressure in injection passage means 220 exceeds the fluid pressure in upper power passage 146 of power passage means 144.

When the upper power piston 128 moves upward relative to housing means 12 to compress upper packer means 122, the upper floating piston 300 initially remains in engagement with lower piston abutment 315 of housing means 12.

After the actuation of upper and lower power pistons 128 and 130 to compress the upper and lower packer means 122 and 124, the mandrel means 42 is moved downward from the first position illustrated in FIGS. 1A-1D to its lower second position previously described, and in moving from its first position to its second position, resilient O-ring seal 100 (see FIG. 1C) moves below upper housing power ports 154 to close upper power passage 146 thereby trapping within upper power chamber 158 the fluid pressure which was there applied to actuate upper power piston 128.

Similarly, when mandrel means 42 is moved downward to its lowe second position relative to housing means 12, resilient O-ring seal 112 (see FIG. 1C) is moved below lower housing power ports 190 thus closing lower power passage 148 and trapping fluid under pressure within lower power chamber 194.

After the mandrel means 42 reaches its lower second position relative to housing means 12, the pressure within mandrel bore 44 may be again increased so as to pump fluid through injection passage 220 and into the portion 225 of well bore 184 between upper and lower packer means 122 and 124. So long as the injection pressure within injection passage means 220 does not exceed the pressure trapped within upper and lower power passages 146 and 148, the upper and lower floating pistons 300 and 302 will remain in place abutting injection port adapter 300 as illustrated in FIG. 1C. This abutting engagement with injection port adapter 30 initially prevents movement of either the upper or lower floating pistons 300 and 302 toward the injection passage means 220.

In the event that the injection pressure within the injection passage means 220 exceeds the pressure trapped within upper or lower power passage 146 or 148, then the associated floating pistion 300 or 302 can move slightly toward its associated power piston so as to transfer that increased fluid pressure to its associated power chamber 158 or 194.

This prevents the fluid pressure being injected into the portion 225 of well bore 184 between upper and lower packer means 122 and 124 from exceeding the pressure within the power chambers 158 and 194.

If it were not for the pressure balance means 298, and if in fact pressure within the portion 225 of well bore 184 between upper and lower packer means 122 and 124 were allowed to exceed the pressure trapped within power chambers 158 and 194, that excessive pressure within portion 225 of well bore 184 could act upon the power pistons opposing the pressure within the power chambers 158 and 194 and cause the power pistons to move back toward an unactuated position thus causing upper and lower packer means 122 and 124 to release their sealing engagement with the well bore 184.

SUMMARY OF OPERATION OF THE INVENTION

With particular reference to FIG. 3, the various methods of using the selective injection packer apparatus 10 of the present invention to inject fluid into a subsurface zone of a well defined by well bore 184 will now be described.

First, the selective injection packer apparatus 10 is connected to a tubing string such as 50.

FIG. 3 schematically illustrates a particular use of the selective injection packer apparatus 10 which is designed for use in low fluid level wells wherein the fluid level within an annulus 324 defined between the tubing string 50 and the well bore 184 generally does not extend all the way to the surface 322 and thus provides a lower hydrostatic head within the annulus 324 than is present within the tubing 50.

In such a low fluid level well environment, the tubing string 50 generally includes a retrievable fluid control valve schematically illustrated by the numeral 326 located above the selective injection packer apparatus 10. The use of such fluid control valves are well known to those skilled in the art, and the fluid control valve acts in the manner of a spring check valve to allow downward fluid flow through the tubing string 50 only upon application of a predetermined downward pressure differential across the fluid control valve 326. This prevents premature actuation of power pistons 128 and 130, due to hydrostatic pressure differentials between the bore of tubing string 50 and the well annulus 324 as the apparatus 10 is lowered into the well.

Generally, a lower seat housing 82 is connected to lower adapter 72 of mandrel means 42 of selective injection packer apparatus 10 as schematically illustrated in FIG. 3.

After the tubing string 50 with the various other apparatus illustrated in FIG. 3 is made up, it is lowered into the well bore 184 from a drilling rig schematically illustrated as 328.

The selective injection packer apparatus 10 is lowered until it is in place adjacent a zone of the well bore 184 which is desired to be treated, tested or the like.

FIG. 3 illustrates a particular use of this selective injection packer apparatus 10 wherein it is being utilized to wash a plurality of perforations such as 330–336.

As illustrated in FIG. 3, the selective injection packer apparatus 10 has been placed so as to straddle perforations 334 and 336 so that perforations 334 and 336 may be washed by pumping fluid downward through the tubing string 50 and selective injection packer apparatus 10. If it is desired to increase the longitudinal spacing between upper and lower packer means 122 and 124, this may be done by replacing injection port adapter 30 with a similar item of longer length and by breaking the threaded connection 70 between upper and lower power mandrels 62 and 68 and placing a spacer mandrel (not shown) of appropriate length therebetween.

When the selective injection packer apparatus 10 is first lowered into position with the upper and lower packer means 122 and 124 straddling the zone including perforations 334 and 336, the selective injection passage apparatus 10 is in the position illustrated in detail in FIGS. 1A–1D, which has previously been defined as the neutral first position of mandrel means 42 relative to housing means 12. In this neutral first position, the upper and lower passages 146 and 148 of power passage means 144 are open, and the injection passage means 220 and both the upper and lower release passages 238 and 240 of release passage means 232 are closed.

Then the bore of the seat housing 82 is blocked by dropping a ball 348 through the bore of tubing string 50, so that ball 348 seals against a seat 350 of seat housing 82.

With the mandrel means 44 in its neutral first position relative to housing means 12 and with the bore of lower seat housing 82 closed by ball 348, fluid pressure is increased within the bore of tubing string 50 and within the mandrel bore 44, and this increased fluid pressure is communicated through the upper and lower power passages 146 and 148 of power passage means 144 with the upper and lower power pistons 128 and 130 of power piston means 126. This actuates the upper and lower power pistons 128 and 130 to compress the upper and lower packer means 122 and 124 and seal the upper and lower packer means 122 and 124 against the well bore 184 above and below the perforations 334 and 336 which are to be washed.

Then, the drilling rig 328 slacks off weight on the tubing string 50 and accordingly on the mandrel means 42 thereby moving the mandrel means 42 downward to its lower second position relative to housing means 12 defined by engagement of abutments 229 and 230 (see FIG. 1B).

This downward movement closes upper and lower power passages 146 and 148 of power passage means 144 thereby trapping fluid under pressure within the upper and lower power chambers 158 and 194 against the upper and lower power pistons 128 and 130, respectively.

Also, this downward movement from the first to the second position of mandrel means 42 relative to housing means 12 moves the mandrel injection ports 224 of injection passage means 220 below O-ring seal means 102 and into registry with groove 226 of injection passage means 220 so as to open injection passage means 220 thereby communicating mandrel bore 44 with the intermediate exterior surface 222 of injection port adapter 30 of housing means 12 between the upper and lower packer means 122 and 124.

With the mandrel means 42 in this lower second position relative to housing means 12, fluid is pumped downward through the bore of tubing string 50 and through mandrel bore 44, then through the injection passage means 220 and into that portion of the well annulus defined between upper and lower packer means 122 and 124. This fluid will accordingly be pumped radially outward through perforations 334 and 336 to wash the perforations 334 and 336.

Also, in this lower second position of mandrel means 42 relative to housing means 12, the fluid pressure within tubing string 50 could be reduced so as to cause fluid to flow from the subsurface formation radially inward through the preforations 334 and 336 into the apparatus 10 through injection passage means 220 to test the zone adjacent perforations 334 and 336.

After the ports 334 and 336 have been washed (or alternatively after that zone adjacent perforations 334 and 336 has been tested), the drilling rig 328 picks up weight from the tubing string 50 thus moving the mandrel means 42 back upward from its said lower second position toward its said neutral first position relative to the housing means 12.

Normally, when the apparatus 10 is being used in a well which is not a low fluid well, as soon as the mandrel means 42 reaches its neutral first position relative to the housing means 12, the fluid pressure within upper and lower power chambers 158 and 194 becomes equal to the pressure within the bore of tubing string 50, which would be normally no greater than the annulus fluid pressure, thus allowing the upper and lower power pistons 128 and 130 to move back toward their unactuated positions thus releasing upper and lower packer means 122 and 124 from sealed engagement with the well bore 184.

In the situation of a low fluid pressure well, or in a number of other circumstances, however, the mere hydrostatic pressure within the tubing string 50 may be sufficiently greater than the low fluid level within the annulus 324 such that the upper and/or lower power pistons 128 and 130 remain in their actuated position holding the upper and lower packer means 122 and 124 in sealed engagement with the well bore 184.

In this situation, the mandrel means 42 will be moved further upward through its neutral first position relative to housing means 12 to its upper third position relative to housing means 12 as defined by engagement of abutments 248 and 250.

This movement to the upper third position of mandrel means 42 opens the upper and lower release passages 238 and 240 of release passage means 232 and concurrently opens both the upper and lower power passages 146 and 148 of power passage means 144 and the injection passage means 220 so that fluid pressures are equalized within the well annulus above upper packer means 122, below lower packer means 124, and within the zone defined between upper and lower packer means 122 and 124. Also, fluid pressures are balanced on both sides of upper and lower power pistions 128 and 130, thus permitting upper and lower power pistons 128 and 130 to move back toward their unactuated positions thus allowing upper and lower packer means 122 and 124 to release their sealed engagement with the well bore 184.

With reference to FIG. 1C, it will be appreciated that as mandrel means 42 moves upward from its neutral first position there illustrated to its upper third position relative to housing means 12, the groove 152 of upper power passage 146 will at all times be in communication with upper housing power ports 154, and also the groove 188 of lower power passage 148 will at all times be in communication with lower housing power ports 190, thus keeping upper and lower power passages 146 and 148 open.

The injection passage means 220 is opened when mandrel means 42 moves upward to its upward third position by means of an intermediate release port 346 of release passage means 232. Intermediate release port 346 is disposed through lower power mandrel 68, and as seen in FIG. 1C, is located below O-ring seals 108 when mandrel means 42 is in its neutral first position. When mandrel means 42 moves upward to its upper third position, the intermediate release port 346 moves above seals 108 thus placing groove 226 and housing injection ports 228 in communication with mandrel bore 44 through the intermediate release port 346.

The resilient biasing means 258, 260 automatically returns the apparatus 10 to its neutral first position as illustrated in FIGS. 1A–1D after the upper and lower packer means 122 and 124 are released from sealed engagement with the well bore 184.

Then, the apparatus 10 may be moved to another location within well bore 184 to wash other perforations or to perform other operations.

The apparatus 10 provides another important function when it is being utilized as illustrated in FIG. 3.

This function is performed in the unusual, but occasionally occurring situation, wherein the well bore 184 below lower packer means 124 draws a vacuum while the upper and lower packer means 122 and 124 are in sealing engagement with the well bore 184.

This is a very dangerous situation in that with selective injection packer apparatus of the prior art, the packer apparatus would be sucked downwardly into the well bore, thus exerting tremendous downward forces on the tubing string 50 which in extreme circumstances can collapse the drilling rig 328.

With the selective injection packer apparatus 10 of the present invention, however, the likelihood of this happening is greatly reduced because the vacuum merely will cause the housing means 12 and the upper and lower packer means 122 and 124 to move downward relative to both the well bore 184 and the mandrel means 42 until the mandrel means 42 is in its upper third position relative to housing means 12 thereby allowing fluid in the annulus above upper packer means 122 by bypass around packer means 122 and 124 through passage 238, mandrel bore 44 and passage 240, even though packer means 122 and 124 will probably stay set until pressures acting upon them equalize.

Thus it is seen that the apparatus and methods of the present invention readily achieve the ends and advantages mentioned as well as those inherent therein. While certain preferred embodiments of the invention have been illustrated for the purposes of the present disclosure, numerous changes in the arrangement and construction of parts and steps may be made by those skilled in the art, which changes are encompassed by the scope and spirit of the present invention as defined by the appended claims.

What is claimed is:

1. A selective injection packer apparatus, comprising:

a housing means having a longitudinal housing bore therethrough;

mandrel means having a longitudinal mandrel bore therethrough, said mandrel means being slidably disposed in said housing bore;

upper and lower longitudinally spaced compressible packer means disposed about said housing means;

power piston means, operably associated with said housing means and said upper and lower packer means, for longitudinally compressing and radially expanding said upper and lower packer means in response to a change in fluid pressure within said mandrel bore;

power passage means, operatively associated with said power piston means, for selectively communicating said mandrel bore and said power piston means;

injection passage means, operatively associated with said housing means and said mandrel means, for selectively communicating said mandrel bore with a first exterior surface of said housing means between said upper and lower packer means; and release passage means, operatively associated with said housing means and said mandrel means, for selectively communicating a second exterior surface of said housing means not between said upper and lower packer means with both said power passage means and said injection passage means concurrently to thereby balance fluid pressures on said power piston means and said upper and lower packer means.

2. The apparatus of claim 1, wherein said release passage means is further characterized as a means for selectively communicating both an upper exterior surface of said housing means above said upper packer means and a lower exterior surface of said housing means below said second packer means with each other and concurrently with both said power passage means and said injection passage means, said upper and lower exterior surfaces being said second exterior surface.

3. The apparatus of claim 1, wherein:

said mandrel means is movable longitudinally relative to said housing means between first, second and third positions;

said power passage means being open and said injection passage means and said release passage means both being closed when said mandrel means is in its said first position relative to said housing means;

said injection passage means being open and said power passage means and said release passage means both being closed when said mandrel means is in its said second position relative to said housing means; and said power passage means, said injection passage means and said release passage means all being open when said mandrel means is in its third position relative to said housing means.

4. The apparatus of claim 3, wherein:

said second position of said mandrel means relative to said housing means is downwardly displaced from said first position of said mandrel means relative to said housing means; and said third position of said mandrel means relative to said housing means is upwardly displaced from said first position of said mandrel means relative to said housing means.

5. The apparatus of claim 3, further comprising:

resilient biasing means, operably associated with said mandrel means and said housing means, for urging said mandrel means back toward its said first position relative to said housing means from either of said second and third positions.

6. The apparatus of claim 5, wherein:

said resilient biasing means comprises a coil compression spring means concentrically located between said mandrel means and said housing means, said spring means including an upper end adapted to engage both an upper mandrel spring abutment of said mandrel means and an upper housing spring abutment of said housing means, and said spring means including a lower end adapted to engage both a lower mandrel spring abutment of said mandrel means and a lower housing spring abutment of said housing means.

7. The apparatus of claim 6, wherein:

said coil compression spring means is in its extended-most position when said mandrel means is in its said first position relative to said housing means, said upper end of said spring means engaging both said upper mandrel spring abutment and said upper housing spring abutment and said lower end of said spring means engaging both said lower mandrel spring abutment and said lower housing spring abutment when said mandrel means is in its said first position relative to said housing means;

said coil compression spring means is compressed between said upper mandrel spring abutment and said lower housing spring abutment when said mandrel means is in its said second position relative to said housing means; and said coil compression spring means is compressed between said upper housing spring abutment and said lower mandrel spring abutment when said mandrel means is in its said third position relative to said housing means.

8. The apparatus of claim 6, wherein:

said coil compression spring means is received in an annular spring chamber defined between an external surface of said mandrel means and an internal surface of said housing means, said spring chamber being communicated with an exterior of said housing means; and wherein said spring chamber has a constant volume as said mandrel means is moved between its first, second and third positions relative to said housing means to thereby prevent well fluid from being sucked into said spring chamber as said mandrel means is moved between its said first, second and third positions.

9. The apparatus of claim 3, wherein:

said mandrel means includes a radially outward extending mandrel limit abutment, and said housing means includes a radially inward extending housing limit abutment, said mandrel limit abutment and said housing limit abutment being arranged to abut each other to define one of said second and third positions of said mandrel means relative to said housing means;

said mandrel limit abutment and said housing limit abutment are both located in an annular chamber defined between said mandrel means and said housing means, said annular chamber being communicated with an exterior of said housing means; and said apparatus further includes a debris shield means, disposed in said annular chamber about said mandrel limit abutment and said housing limit abutment, for preventing debris from collecting between said mandrel limit abutment and said housing limit abutment.

10. The apparatus of claim 1, further comprising:

pressure balance means, operatively associated with said power passage means and said injection passage means, for transferring to said power passage means and thus to said power piston means any pressure in said injection passage means in excess of a pressure trapped in said power passage means when said power passage means is closed and said injection passage means is open and for thereby preventing said upper and lower packer means from being unseated from a well bore due to excessive pressure in said injection passage means and in said well bore between said upper and lower packer means.

11. The apparatus of claim 10, wherein:

said pressure balance means includes a sealed floating piston having a first end thereof in communication with said power passage means and having a second end thereof in communication with said injection passage means, said floating piston being so arranged and constructed that after said power piston means is actuated to compress said upper and lower packer means, movement of said floating piston toward said injection passage means is initially prevented and movement of said floating piston toward said power passage means is allowed.

12. A selective injection packer apparatus, comprising:

a housing means having a longitudinal housing bore therethrough;

mandrel means having a longitudinal mandrel bore therethrough, said mandrel means being slidably disposed in said housing bore;

upper and lower longitudinally spaced compressible packer means disposed about said housing means;

power piston means, operably associated with said housing means and said upper and lower packer means, for longitudinally compressing and radially expanding said upper and lower packer means in response to a change in fluid pressure within said mandrel bore;

power passage means, operatively associated with said power piston means, for selectively communicating said mandrel bore and said power piston means;

injection passage means, operatively associated with said housing means and said mandrel means, for selectively communicating said mandrel bore with an exterior surface of said housing means between said upper and lower packer means; and pressure balance means, operatively associated with said power passage means and said injection passage means, for transferring to said power passage means and thus to said power piston means any pressure in said injection passage means in excess of a pressure trapped in said power passage means when said power passage means is closed and said injection passage means is open and for thereby preventing said upper and lower packer means from being unseated from a well bore due to excessive pressure in said injection passage means and in said well bore between said upper and lower packer means.

13. The apparatus of claim 12, wherein:

said pressure balance means includes a sealed floating piston having a first end thereof in communication with said power passage means and having a second end thereof in communication with said injection passage means, said floating piston being so arranged and constructed that after said power piston means is actuated to compress said upper and lower packer means, movement of said floating piston toward said injection passage means is initially prevented and movement of said floating piston toward said power passage means is allowed.

14. The apparatus of claim 13, wherein:

said power piston means includes separate upper and lower power pistons associated with said upper and lower packer means, respectively;

said upper power piston includes an upper inner bore slidably received about a cylindrical outer surface of said housing means with a first sliding seal means being provided therebetween, and said upper power piston includes a lower enlarged inner diameter counterbore slidably received about an enlarged diameter cylindrical outer surface of said housing means with a second sliding seal means being provided therebetween, said first and second sliding seal means defining a differential area piston upon said upper power piston;

said power passage means includes an annular power chamber defined between said housing means and the counterbore of said upper power piston, said annular power chamber being communicated with said differential area piston of said upper power piston; and wherein said sealed floating piston of said pressure balance means is disposed in said annular power chamber.

15. The apparatus of claim 14, wherein:

said floating piston is held longitudinally in place between a lower piston abutment of said housing means and an upper piston abutment of said upper power piston when said upper power piston is in an unactuated position prior to compression of said upper packer means.

16. The apparatus of claim 15, wherein:

said upper power piston is so arranged and constructed that when said upper power piston is in an actuated position compressing said upper packer means, said upper piston abutment of said upper power piston is out of engagement with said floating piston so that said floating piston is free to move upward if fluid pressure in said injection passage means exceeds fluid pressure in said power passage means.

17. A method of injecting fluid into a subsurface zone of a well, said method comprising the steps of:

placing in said well adjacent said zone a selective injection packer apparatus of the type having a housing means, upper and lower compressible packer means disposed about said housing means, power piston means associated with said upper and lower packer means for compressing said upper and lower packer means, and mandrel means slidably received in said housing means, said mandrel means having a mandrel bore adapted to be communicated with a tubing bore of a tubing bore of a tubing string to which said selective injection packer apparatus is connected;

with said mandrel means is a neutral first position relative to said housing means, increasing fluid pressure within said tubing bore and said mandrel bore and communicating said increased fluid pressure through a power passage means to said power piston means and thereby actuating said power piston means to compress said upper and lower packer means and seal said upper and lower packer means against a bore of said well above and below said zone;

slacking off weight on said tubing string and thereby moving said mandrel means downward to a lower second position relative to said housing means, said downward movement closing said power passage means and thereby trapping fluid under pressure within said power passage means against said power piston means and said downward movement opening an injection passage means communicating said mandrel bore and an intermediate exterior surface of said housing means between said upper and lower packer means;

with said mandrel means in said lower second position relative to said housing means, pumping fluid through said tubing bore, said mandrel bore and said injection passage means and into said zone of said well between said upper and lower packer means; and picking up weight from said tubing string and thereby moving said mandrel means upward from said second position through said first position to an upper third position relative to said housing means, said upward movement to said third position opening said power passage means and said injection passage means concurrently and opening a release passage means communicating an upper exterior surface of said housing means above said upper packer means and a lower exterior surface of said housing means below said lower packer means with said mandrel bore thereby balancing fluid pressures on said power piston means and said upper and lower packer means thus releasing said upper and lower packer means from sealed engagement with said well bore.

18. The method of claim 17, further comprising the step of:

resiliently biasing said mandrel means toward its neutral first position relative to said housing means from either of its said lower second and upper third positions, so that once said upper and lower packer means are disengaged from said well bore said mandrel means is automatically returned to its neutral first position.

19. The method of claim 17, further comprising the steps of:

when said mandrel means is in said lower second position relative to said housing means, transferring to said power passage means and thus to said power piston means any pressure in said injection passage means in excess of said pressure trapped in said power passage means against said power piston means; and thereby preventing said upper and lower packer means from disengaging said well bore due to excessive pressure in said injection passage means and in said well bore between said upper and lower packer means.

20. The method of claim 17, further comprising the steps of:

when said upper and lower packer means are sealingly engaged with said well bore and said well draws a vacuum below said lower packer means, permitting said housing means and said upper and lower packer means to move downward relative to both said well bore and said mandrel means until said mandrel means is in its upper third position relative to said housing means thereby releasing said upper and lower packer means from sealed engagement with said well bore and preventing a drilling rig from which said tubing string is suspended from being pulled down by said vacuum below said lower packer means.

* * * * *